US006416564B1

(12) United States Patent
Bond et al.

(10) Patent No.: US 6,416,564 B1
(45) Date of Patent: Jul. 9, 2002

(54) METHOD FOR PRODUCING LARGE DIAMETER INGOTS OF NICKEL BASE ALLOYS

(75) Inventors: Betsy J. Bond; Laurence A. Jackman, both of Monroe; A. Stewart Ballantyne, Charlotte, all of NC (US)

(73) Assignee: ATI Properties, Inc.

( * ) Notice: Subject to any disclaimer, the term of this patent is extended or adjusted under 35 U.S.C. 154(b) by 0 days.

(21) Appl. No.: 09/802,064

(22) Filed: Mar. 8, 2001

(51) Int. Cl.[7] ..... C22B 9/18; C22B 9/20
(52) U.S. Cl. ..... 75/10.25; 148/677; 420/590
(58) Field of Search ..... 75/10.25; 148/677; 420/590

(56) References Cited

U.S. PATENT DOCUMENTS

| | | | | |
|---|---|---|---|---|
| 3,677,830 A | | 7/1972 | Cox et al. | |
| 3,975,219 A | | 8/1976 | Allen et al. | |
| 4,144,102 A | | 3/1979 | Smith, Jr. et al. | |
| 5,129,970 A | | 7/1992 | Henry | |
| 5,131,961 A | | 7/1992 | Sato et al. | |
| 5,328,659 A | | 7/1994 | Tillman et al. | |
| 5,424,029 A | | 6/1995 | Kennedy et al. | |
| 5,888,316 A | * | 3/1999 | Erickson | 148/410 |

OTHER PUBLICATIONS

Kissinger, R.D. "Trends and Near Term Requirements For GE Airdraft Engines Titanium and Nickel Base Disk Alloys" From The Conference:Electron Beam Melting and Refining—State of The Art 1991 in Reno Nevada. pp. 25–27, Published Oct. 1992.*

Choudhury, A. "State of the Art of Superalloy Production for Aerospace and Other Applciation Using VIM/VAR or VIM/ESR" From ISIJ Internation, pp. 563–574. 32(5), May 1992.*

Moyer et al. "Advances in Triple Metling Superalloys 718, 706, and 720" From The Proceedings of The International Symposium on Superalloys 718, 625, 706, and Various Derivatives Sponsored by The Minerals, Metals and Materials Society. pp. 39–48, 1994.*

Cordy et al. "Chemistry and Structure Control in Remelted Superalloy Ingots" From the Proc. Vac. Metall. Conf. Spec. Met. Metling Process. pp. 69–74, 1984.*

"Large Diameter Superalloy Ingots" by R. Kennedy, S. Ballantyne, B. Bond and L. Jackman; Advanced Technologies for Superalloy Affordability, The Minerals, Metals & Materials Society, 2000. No Month.

R. C. Schwant et al., "Large 718 Forgings for Land Based Turbines" *Superalloys 718,625,706 and Various Derivatives* (Minerals, Metals & Materials Society, 1997), pp. 141–152. No Month.

* cited by examiner

*Primary Examiner*—Roy King
*Assistant Examiner*—Tima McGuthry-Banks
(74) *Attorney, Agent, or Firm*—P. J. Viccaro

(57) ABSTRACT

A method of producing a nickel base alloy includes casting the alloy within a casting mold and subsequently annealing and overaging the ingot at at least 1200° F. (649° C.) for at least 10 hours. The ingot is electroslag remeelted at a melt rate of at least 8 lbs/min (3.63 kg/mm.), and the ESR ingot is then transferred to a heating furnace within 4 hours of complete solidification and is subjected to a novel post-ESR heat treatment. A suitable VAR electrode is provided form the ESR ingot, and the electrode is vacuum arc remelted at a melt rate of 8 to 11 lbs/minute (3.63 to 5.00 kg/minute) to provide a VAR ingot. The method allows premium quality VAR ingots having diameters greater than 30 inches (762 mm) to be prepared from Alloy 718 and other nickel base superalloys subject to significant segregation on casting.

33 Claims, 3 Drawing Sheets

METHOD FOR PRODUCING LARGE DIAMETER INGOTS OF NICKEL BASE ALLOYS

CROSS REFERENCE TO RELATED APPLICATIONS

Not applicable.

STATEMENT REGARDING FEDERALLY SPONSORED RESEARCH OR DEVELOPMENT

Not applicable.

TECHNICAL FIELD AND INDUSTRIAL APPLICABILITY OF THE INVENTION

The present invention relates to an improved method for producing large diameter, premium quality ingots of nickel base superalloys. The present invention more particularly relates to a method for producing ingots of nickel base superalloys, including Alloy 718 (UNS N07718) and other nickel base superalloys experiencing significant segregation during casting, and wherein the ingots have a diameter greater than 30 inches (762 mm) and are substantially free of negative segregation, are free of freckles, and are free of other positive segregation. The present invention also is directed to ingots of Alloy 718 having diameters greater than 30 inches (762 mm), as well as to any ingots, regardless of diameter, formed using the method of the invention. The method of the present invention may be applied in, for example, the manufacture of large diameter, premium quality ingots of nickel base superalloys that are fabricated into rotating parts for power generation. Such parts include, for example, wheels and spacers for land-based turbines and rotating components for aeronautical turbines.

DESCRIPTION OF THE INVENTION BACKGROUND

In certain critical applications, components must be manufactured from nickel base superalloys in,the form of large diameter ingots that lack significant segregation. Such ingots must be substantially free of positive and negative segregation, and should be completely free of the manifestation of positive segregation known as "freckles". Freckles are the most common manifestation of positive segregation and are dark etching regions enriched in solute elements. Freckles result from the flow of solute-rich interdendritic liquid in the mushy zone of the ingot during solidification. Freckles in Alloy 718, for example, are enriched in niobium compared to the matrix, have a high density of carbides., and usually contain Laves phase. "White spots" are the major type of negative segregation. These light etching regions, which are depleted in hardener solute elements, such as niobium, typically are classified into dendritic, discrete, and solidification white spots. While there can be some tolerance for dendritic and solidification white spots, discrete white spots are of major concern because they frequently are associated with a cluster of oxides and nitrides that can act as a crack initiator.

Ingots substantially lacking positive and negative segregation and that are also free of freckles are referred to herein as "premium quality" ingots. Premium quality nickel base superalloy ingots are required in certain critical applications including, for example, rotating components in aeronautical or land-based power generation turbines and in other applications in which segregation-related metallurgical defects may result in catastrophic failure of the component. As used herein, an ingot "substantially lacks" positive and negative segregation when such types of segregation are wholly absent or are present only to an extent that does not make the ingot unsuitable for use in critical applications, such as use for fabrication into rotating components for aeronautical and land-based turbine applications.

Nickel base superalloys subject to significant, positive and negative segregation during casting include, for example, Alloy 718 and Alloy 706. In order to minimize segregation when casting these alloys for use in critical applications, and also to better ensure that the cast alloy is free of deleterious non-metallic inclusions, the molten metallic material is appropriately refined before being finally cast. Alloy 718, as well as certain other-segregation-prone nickel base superalloys such as Alloy 706 (UNS N09706), are typically refined by a "triple melt" technique which combines, sequentially, vacuum induction melting (VIM), electroslag remelting (ESR), and vacuum arc remelting (VAR). Premium quality ingots of these segregation-prone materials, however, are difficult to produce in large diameters by VAR melting, the last step in the triple melt sequence. In some cases, large diameter ingots are fabricated into single components, so areas of unacceptable segregation in VAR-cast ingots cannot be selectively removed prior to component fabrication. Consequently, the entire ingot or a portion of the ingot may need to be scrapped.

VAR ingots of Alloy 718, Alloy 706, and other nickel base superalloys such as Alloy 600, Alloy 625, Alloy 720, and Waspaloy, are increasingly required in larger weights, and correspondingly larger diameters, for emerging applications. Such applications include, for example, rotating components for larger land based and aeronautical turbines under development. Larger ingots are needed not only to achieve the final component weight economically, but also to facilitate sufficient thermomechanical working to adequately break down the ingot structure and achieve all of the final mechanical and structural requirements.

The melting of large superalloy ingots accentuates a number of basic metallurgical and processing related issues. Heat extraction during melting becomes more difficult with increasing ingot diameter, resulting in longer solidification times and deeper molten pools. This increases the tendency towards positive and negative segregation. Larger ingots and electrodes can also generate higher thermal stresses during heating and cooling. While ingots of the size contemplated by this invention have been successfully produced in several nickel base alloys (for example, Alloys 600, 625, 706, and Waspaloy) Alloy 718 is particularly prone to these problems. To allow for the production of large diameter VAR ingots of acceptable metallurgical quality from Alloy 718 and certain other segregation-prone nickel base superalloys, specialized melting and heat treatment sequences have been developed. Despite these efforts, the largest commercially available premium quality VAR ingots of Alloy 718, for example, are currently 20 inches (508 mm) in diameter, with limited material produced at up to 28-inch (711 mm) diameters. Attempts at casting larger diameter VAR ingots of Alloy 718 material have been unsuccessful due the occurrence of thermal cracking and undesirable segregation. Due to length restrictions, 28-inch VAR ingots of Alloy 718 weigh no more than about 21,500 lbs (9772 kg). Thus, Alloy 718 VAR ingots in the largest commercially available diameters fall far short of the weights needed in emerging applications requiring premium quality nickel base superalloy material.

Accordingly, there is a need for an improved method of producing premium quality, large diameter VAR ingots of Alloy 718. There also is a need for an improved method of producing ingots of other segregation-prone nickel base superalloys that are substantially free of negative segregation, are free of freckles, and substantially lack other positive segregation.

BRIEF SUMMARY OF THE INVENTION

In order to address the above-described needs, the present invention provides a novel method of producing a nickel base superalloy. The method may be used to cast VAR ingots of premium quality from Alloy 718 in diameters greater than 30 inches (762 mm) and having weights in excess of 21,500 lbs (9772 kg). It is believed that the method of the present invention also may be applied in the production of large diameter VAR ingots from other nickel base superalloys subject to significant segregation during casting, such as, for example, Alloy 706.

The method of the present invention includes the initial step of casting a nickel base superalloy within a casting mold. This may be accomplished by VIM, argon oxygen decarburization (AOD), vacuum oxygen decarburization (VOD), or any other suitable primary melting and casting technique. The cast ingot is subsequently annealed and overaged by, heating the alloy at a furnace temperature of at least 1200° F. (649° C.) for at least 10 hours. (As used herein, "subsequent" and "subsequently" refer to method steps or events that occur immediately one after another, but also refer to method steps or other events that are separated in time and/or by intervening method steps or other events.) In a subsequent step, the ingot is applied as an ESR electrode and, is electroslag remelted at a melt rate of at least 8 lbs/min. (3.63 kg/min.).

The ESR ingot is transferred to a heating furnace within 4 hours of complete solidification, and is subsequently subjected to a post-ESR heat treatment. The heat treatment includes the steps of holding the alloy at a first furnace temperature of 600° F. (316° C.) to 1800° F. (982° C.) for at least 10 hours, and then increasing the furnace temperature, in either a single, stage or in multiple stages, from the first furnace temperature to a second furnace temperature of at least 2125° F. (1163° C.) in a manner that inhibits thermal stresses within the ingot. The ingot is held at the second temperature for at least 10 hours to provide the ingot with a homogenized structure and with minimal Laves phase.

In some instances, the ESR ingot may be cast with a diameter that is larger than the desired diameter of the VAR electrode to be used in a subsequent step of-the method. Therefore, the method of the present invention may include, subsequent to holding the ESR ingot at the second furnace temperature, and prior vacuum arc remelting, mechanically working the ESR ingot at elevated temperature to alter dimensions of the ingot and to provide a VAR electrode of the desired diameter. Thus, after the ESR ingot has been held at the second furnace temperature, it may be further processed in one of several ways, including cooling to a suitable mechanical working temperature or cooling to about room temperature and subsequently reheating to a suitable mechanical working temperature. Alternatively, if adjustment of ingot diameter is unnecessary, the ingot may be directly cooled to room temperature and subsequently processed by vacuum arc remelting without the step of mechanical working. All steps of cooling and reheating the ESR ingot subsequent to holding the ESR ingot at the second temperature are carried out in a manner that inhibits thermal stresses and that will not result in thermal cracking of the ingot.

In a subsequent step of the present method, the ESR ingot is vacuum arc remelted at a melt rate of 8 to 11 lbs/minute (3.63 to 5 kg/minute) to provide a VAR ingot. The VAR melt rate is preferably 9 to 10.25 lbs/minute (4.09 to 4.66 kg/min), and is more preferably 9.25 to 10.2 lbs/minute (4.20 to 4.63 kg/minute). The VAR ingot preferably has a diameter greater than 30 inches (762 mm), and more preferably has a diameter of at least 36 inches (914 mm).

The present invention is further directed to a method of producing a nickel base superalloy that is substantially free of positive and negative segregation and that includes the step of casting in a casting mold an alloy selected from Alloy 718 and other nickel base superalloys subject to significant segregation during casting. The cast ingot is subsequently annealed and overaged by heating at a furnace temperature of at least 1550° F. (843° C.) for at least 10 hours. The annealed ingot is subsequently electroslag remelted at a melt rate of at least about 10 lbs/min. (4.54 kg/min.), and the ESR ingot is then transferred to a heating furnace within 4 hours of complete solidification. In subsequent steps, the ESR ingot is subjected to a multi-stage post-ESR heat treatment by holding the ingot at a first furnace temperature of 900° F. (482° C.) to 1800° F. (982° C.) for at least 10 hours. The furnace temperature is subsequently. increased by no more than 100° F./hour (55.6° C./hour) to an intermediate furnace temperature, and is subsequently further increased by no more than 200° F./hour (111° C./hour) to a second furnace temperature of at least 2125° F. (1163° C.). The ingot is held at the second furnace temperature for at least 10 hours. The ESR ingot may be converted to a VAR electrode of appropriate dimensions, if necessary, and is subsequently vacuum arc remelted at a melt rate of 8 to 11 lbs/minute (3.63 to 5 kg/minute) to provide a VAR ingot. If desired, the VAR ingot may be further processed, such as by a homogenization and/or suitable mechanical conversion to desired dimensions.

The present invention also is directed to VAR ingots produced according to the method of the invention. In addition, the present invention is directed to VAR ingots of Alloy 718 which have a diameter greater than 30 inches, and is further directed to, premium quality Alloy 718 ingots having a diameter greater than 30 inches and which are produced by VAR or by any other melting and casting technique.

The present invention also encompasses articles of manufacture produced by fabricating the articles from ingots within the present invention. Representative articles of manufacture that may be fabricated from the ingots of the present invention include, for example, wheels and spacers for use in land-based turbines and rotating components for use in aeronautical turbines.

The reader will appreciate the foregoing details and advantages of the present invention, as well as others, upon consideration of the following detailed description of embodiments of the invention. The reader also may comprehend such additional advantages and details of the present invention upon carrying out or using the invention.

BRIEF DESCRIPTION OF THE DRAWINGS

The features and advantages of the present invention may be better understood by reference to the accompanying drawings in which.

DETAILED DESCRIPTION OF EMBODIMENTS OF THE INVENTION

Figure 1:
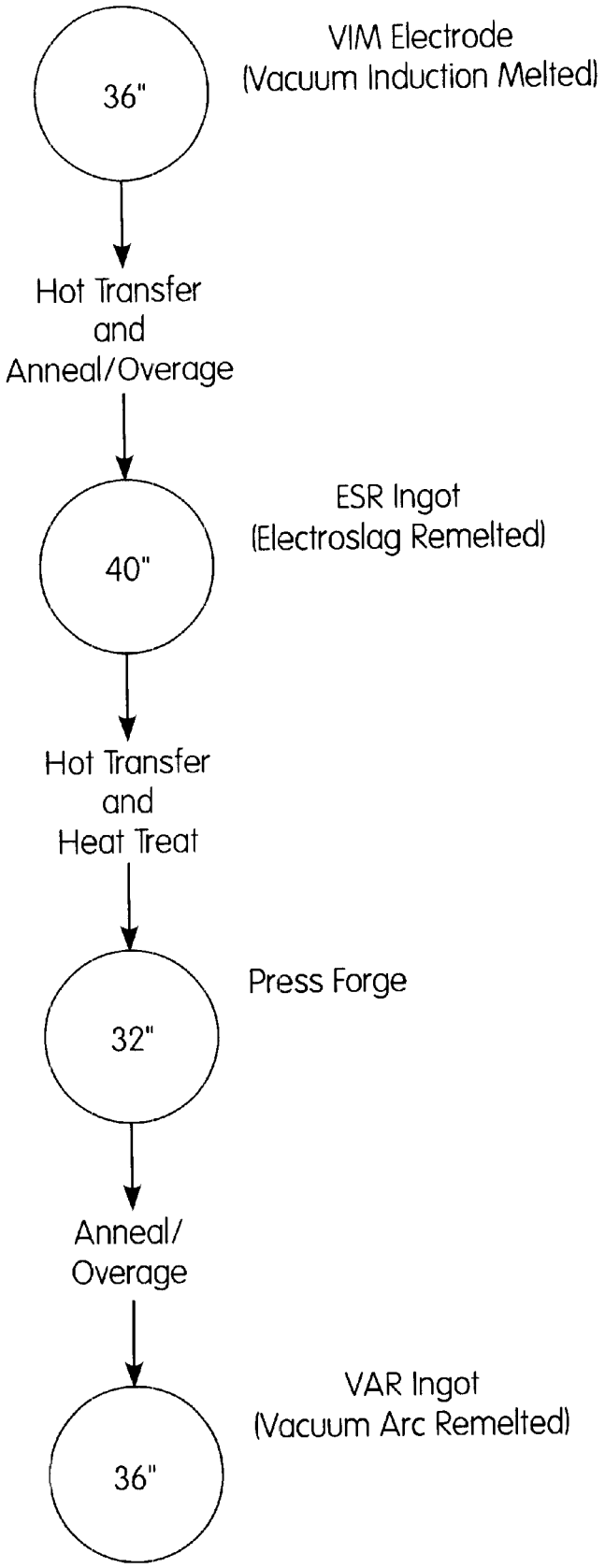
FIG. 1. is a diagram generally illustrating of one embodiment of the method of the present invention, wherein the ESR ingot has a 40-inch diameter and is converted to a 32-inch diameter VAR electrode prior to vacuum arc remelting.

The method of the present invention allows for the production of premium quality, large diameter ingots from Alloy 718, a nickel base superalloy that is prone to segregation on casting. Previous to the development of the present method, the heaviest commercially available ingots of Alloy 718 were limited to about 28 inches (711 mm) in diameter, with maximum weights of about 21,500 lbs (9773 kg) because of length/diameter limitations. The inventors have successfully produced premium quality ingots of Alloy 718 with diameters greater than 30 inches (762 mm) and at least 36 inches (914 mm) by the present method. These ingots weighed as much as 36,000 lbs (16,363 kg), well in excess of the previous maximum weight for premium quality 718 Alloy VAR ingots. The inventors believe that the method of the present invention may be used to produce VAR ingots of other nickel base superalloys that typically experience significant segregation during casting. Such other alloys include, for example, Alloy 706.

The method of the present invention includes the step of casting a nickel base superalloy within a casting mold. As noted, the nickel base alloy may be, for example, Alloy 718. Alloy 718 has the following broad composition, all in weight percentages: about 50.0 to about 55.0 nickel; about 17 to about 21.0 chromium; 0 up to about 0.08 carbon; 0 up to about 0.35 manganese; 0 up to about 0.35 silicon; about 2.8 up to about 3.3 molybdenum; at least one of niobium and tantalum, wherein the sum of niobium and tantalum is about 4.75 up to about 5.5; about 0.65 up to about 1.15 titanium; about 0.20 up to about 0.8 aluminum; 0 up to about 0.006 boron; and iron and incidental impurities. Alloy 718 is available under the trademark Allvac 718 from the Allvac division of Allegheny Technologies Incorporated, Pittsburgh, Pa. Allvac 718 has the following nominal composition (in weight percentages) when cast in larger VAR ingot diameters: 54.0 nickel; 0.5 aluminum; 0.01 carbon; 5.0 niobium; 18.0 chromium; 3.0 molybdenum; 0.9 titanium; and iron and incidental impurities.

Any suitable technique may be used to melt and cast the alloy within a casting mold. Suitable techniques include, for example, VIM, AOD, and VOD. The choice of melting and casting technique is often dictated by a combination of cost and technical issues. Electric arc furnace/AOD melting facilitates the use of low cost raw materials, but tends to be lower in yield than VIM melting, particularly if bottom pouring is used. As the cost of raw materials increases, the higher yield from VIM melting may make this a more economical approach. Alloys containing higher levels of reactive elements may require VIM melting to ensure adequate recovery. The need for low gaseous residual contents, particularly nitrogen, also may dictate the use of VIM melting to reach the desired levels.

After the alloy has been cast, it may be held within the mold for a certain period to ensure sufficient solidification so that it may be stripped safely from the casting mold. Those of ordinary skill in the art may readily determine a sufficient time, if any, to hold the cast ingot within mold. That time will depend on, for example, the size and dimensions of the ingot, the parameters of the casting operation, and the composition of the ingot.

Subsequent to removing the cast ingot from casting mold, it is placed in a heating furnace and is annealed and overaged by heating at a furnace temperature of least 1200° F. (649° C.) for at least 10 hours. Preferably, the ingot is heated at a furnace temperature of at least 1200° F. (649° C.) for at least 18 hours. A more preferable heating temperature is at least 1550° F. (843° C.). The annealing and overaging heat treatment is intended to remove residual stresses within the ingot created during solidification. As ingot diameter increases, residual stresses become more of a concern because of increased thermal gradients within the ingot and the degree of microsegregation and macrosegregation increases, raising the sensitivity to thermal cracking. When residual stresses become excessive, thermal cracks can initiate. Some thermal cracks may be catastrophic, resulting in the need to scrap the product. Cracking may also be more subtle and result in melting irregularities and subsequent unacceptable segregation. One type of melting irregularity known as a "melt rate cycle" is caused by thermal cracks introduced into the ESR and VAR electrode that interrupt heat conduction along the electrode from the tip that is melting. This concentrates the heat below the crack, which causes the melt rate to increase as the melting interface approaches the crack. When the crack is reached, the end of the electrode is relatively cold, making the melting-process suddenly slower. As the crack region melts, the melt rate gradually increases until a steady state temperature gradient is reestablished in the electrode and the nominal melt rate is reached.

In a subsequent step, the ingot is used as an ESR electrode to form an ESR ingot. The inventors have determined that an ESR melt rate of at least about 8 lbs/minute (3.63 kg/minute), and more preferably at least 10 lbs/minute (4.54 kg/minute) should be used to provide an ESR ingot suitable for further processing to a large diameter VAR ingot. Any suitable flux and flux feed rate may be used, and those having ordinary skill in the art may readily determine suitable fluxes and feed rates for a given ESR process. To some extent, the suitable melting rate will depend on the desired ESR ingot diameter and should be selected to provide an ESR ingot of a solid construction (i.e., substantially lacking voids and cracks), having reasonably good surface quality, and lacking excessive residual stresses to inhibit thermal cracking. The general operation of ESR equipment and the general manner of conducting the remelting operation are well known to those of ordinary skill in the art. Such persons may readily electroslag remelt an ESR electrode of a nickel base superalloy, such as Alloy 718, at the melt rate specified in the present method without further instruction.

Once the electroslag remelting operation has been completed, the ESR ingot may be allowed to cool in the crucible to better ensure that all molten metal has solidified. The minimum suitable cool time will largely depend on ingot diameter. Once removed from the crucible, the ingot is transferred to a heating furnace so that it may be subjected to a novel post-ESR heat treatment according to-the present invention and as follows.

The inventors have discovered that in the production of large diameter ingots of Alloy 718, it is, important that the ESR ingot is hot transferred into the heating furnace and that the post-ESR heat treatment be initiated within 4 hours from the complete solidification of the ESR ingot. Once the ESR ingot has been transferred to the heating furnace, the post- ESR heat treatment is initiated by holding the ingot at a first furnace temperature in the range of at least 600° F. (316° C.) up to 1800° F. (982° C.) for at least 10 hours. More preferably, the furnace temperature range is least 900° F. (482° C.) Unto 180° F. (982° C.). It also is preferred that the heating time at the selected furnace temperature is, at least 20 hours.

After the step of holding the furnace temperature for at least 10 hours, the heating furnace temperature is increased from the first furnace temperature up to a second furnace temperature of at least 2125° F. (1163° C.), and preferably at least 2175° F. (1191° C.), in a manner that inhibits the generation of thermal stresses within the ESR ingot. The increase in furnace temperature up to the second furnace temperature may be performed in a single stage or as a multiple-stage operation including two or more heating stages. The inventors have determined that a particularly satisfactory sequence of increasing temperature from the first to the second furnace temperatures is a two-stage sequence including: increasing furnace temperature from the first temperature by no greater than 100°/hour (55.6° C./hour), and preferably about 25° F./hour (13.9° C./hour), to an intermediate temperature; and then further increasing furnace temperature from the intermediate temperature by no greater than 200° F./hour (111° C./hour), and preferably about 50° F./hour (27.8° C./hour), to the second furnace temperature. Preferably, the intermediate temperature is at least 1000° F. (583° C.), and more preferably is at least 1400° F. (760° C.).

The ESR ingot is held at the second furnace temperature for at least 10 hours. The inventors have determined that after being held at the second furnace temperature, the ingot should exhibit a homogenized structure and include only minimal Laves phase. In order to better ensure that that desired structure and the desired degree of annealing is achieved, the ESR ingot is preferably held at the second furnace temperature for at least 24 hours, and is more preferably held at the second furnace temperature for about 32 hours.

After the ESR ingot has been held at the second furnace temperature for the specified period, it may be further processed in one of several ways. If the ESR ingot will not be mechanically worked, it may be cooled from the second furnace temperature to room temperature in a manner that inhibits thermal cracking. If the ESR ingot has a diameter that is greater than the desired diameter of the VAR electrode, the ESR ingot may be mechanically worked such as by, for example, hot forging. The ESR ingot may be cooled from the second furnace temperature to a suitable mechanical working temperature in a manner selected to inhibit thermal cracking. If, however, the ESR ingot has been cooled below a suitable working temperature, it may be reheated to the working temperature in a fashion that inhibits thermal cracking and may then be worked to the desired dimensions.

The inventors have determined that when cooling the ESR ingot from the second furnace temperature, it is desirable to do so in a controlled manner by reducing furnace temperature from the second furnace temperature while the ingot remains in the heating furnace. A preferred cooling sequence that has been shown to prevent thermal cracking includes: reducing the furnace temperature from the second furnace temperature at a rate no greater than 200° F./hour (111° C./hour), and preferably at about 100° F./hour (55.6° C./hour), to a first intermediate temperature not greater than 1750° F. (954° C.), and preferably not greater than 1600° F. (871° C.); holding at the first intermediate temperature for at least 10 hours, and preferably at least 18 hours; further reducing the furnace temperature from the first intermediate temperature at a rate not greater than 150° F./hour (83.3° C./hour), and preferably about 75° F./hour (41.7° C./hour), to a second intermediate temperature not greater than 1400° F. (760° C.), and preferably not greater than 1150° F. (621° C.); holding at the second intermediate temperature for at least 5 hours, and preferably at least 7 hours; and subsequently air cooling the ingot to room temperature. Once cooled to room temperature, the ingot should exhibit an overaged structure of delta phase precipitates.

If the ESR ingot is cooled from the second furnace temperature to a temperature at which mechanical working will be carried out, then the relevant portion of the cooling sequence just described may be used to achieve the working temperature. For example, if the ESR ingot is being heated in a heating furnace at a second furnace temperature of 2175° F. (1191° C.) and is to be hot forged at a forging temperature of 2025° F. (1107° C.), the ESR ingot may be cooled by reducing the furnace temperature from the second furnace temperature at a rate no greater than 200° F./hour (111° C./hour), and preferably at about 100° F./hour, to the forging temperature.

The inventors have determined that if the ESR ingot has been cooled from the second furnace temperature to a temperature at or near room temperature, then heating the ingot back to a suitable mechanical working temperature may be conducted using the following sequence in order to inhibit thermal cracking: charge the ingot to a heating furnace and heat the ingot at a furnace temperature less than 1000° F. (556° C.) for at least 2 hours; increase the furnace temperature at less than 40° F./hour (22.2° C./hour) to less than 1500° F. (816° C.); further increase the furnace temperature at less than 50° F./hour (27.8° C./hour) to a suitable hot working temperature less than 2100° F. (1149° C.); and hold the ingot at the working temperature for at least 4 hours. In an alternate heating sequence developed by the inventors, the ESR ingot is placed in a heating furnace and the following heating sequence is followed: the ingot is heated at a furnace temperature of at least 500° F. (260° C.), and preferably at 500–1000° F. (277–556° C.), for at least 2 hours; the furnace temperature is increased by about 20–40° F./hour (11.1–22.2° C./hour) to at least 800° F. (427° C.); the furnace temperature is further increased by about 30–50° F./hour (16.7–27.8° C./hour) to at least 1200° F. (649° C.); the furnace temperature is further increased by about 40–60° F./hour (22.2–33.3° C./hour) to a hot working temperature-less than 2100° F. (1149° C.); and the ingot is held at the hot working temperature until the ingot achieves a substantially uniform temperature throughout.

If the ESR ingot has been cooled or heated to a desired mechanical working temperature, it is then worked in any suitable manner, such as by press forging, to provide a VAR electrode having a predetermined diameter. Reductions in diameter may be necessitated by, for example, limitations on available equipment. As an example, it may be necessary to mechanically work an ESR ingot having a diameter of about 34 to about 40 inches (about 864 to about 1016 mm) to a diameter of 34 inches (about 864 mm) or less so that it may suitably be used as the VAR electrode on available VAR equipment.

To this point, the ESR ingot will have been subjected to the post-ESR heat treatment. It also has assumed, either as cast on the ESR apparatus or after mechanical working, a suitable diameter for use as the VAR electrode. The ESR ingot may then be conditioned and cropped to adjust its shape to that suitable for use as a VAR electrode, as is known in the art. The VAR electrode is subsequently vacuum arc remelted data rate of 8 to 11 lbs/minute. (3.63 to 5 kg/minute) in a manner known to those of ordinary skill in the art to provide a VAR ingot of the desired diameter. The VAR melt rate is preferably 9 to 10.25 lbs/minute (4.09 to 4.66 kg/min), and is even more preferably 9.25 to 10.2 lbs/minute (4.20 to 4.63 kg/minute). The inventors have determined that the VAR melt rate is critical to achieving premium quality VAR ingots of Alloy 718 material.

The cast VAR ingot may be further processed, if desired. For example, the VAR ingot may be homogenized and overaged using techniques conventional in the production of commercially available larger diameter nickel base superalloy VAR ingots.

Nickel base superalloy ingots produced by the method of the present invention may be fabricated into articles of manufacture by known manufacturing techniques. Such articles would naturally include certain rotating components adapted for use in aeronautical and land-based power generation turbines.

Examples of the method of the present invention follow.

EXAMPLE 1

FIG. 1 is a diagram generally depicting an embodiment of the method of the present invention adapted for producing premium quality ingots of Alloy 718 with diameters greater than 30 inches. It will be apparent that the embodiment of the present method shown in FIG. 1 is, in general, a triple-melt process including steps of VIM, ESR, and VAR. As indicated in FIG. 1, a heat of Alloy 718 was prepared by VIM and cast to a 36-inch diameter VIM electrode suitable for use as an ESR electrode in a subsequent step. The VIM ingot was allowed to remain in the casting mold for 6 to 8 hours after casting. The ingot was then stripped from the mold and transferred hot to a furnace, where it was annealed and overaged at 1550° F. (843° F.) for 18 hours minimum.

After the anneal/overage step, the ingot surface was ground to remove scale. The ingot was then transferred hot to an ESR apparatus, where it was used as the ESR consumable electrode and was electroslag remelted to form a 40-inch ESR ingot. As is well known, an ESR apparatus includes an electric power supply that is in electrical contact with the consumable electrode. The electrode is in contact with a slag disposed in a water-cooled vessel, typically constructed of copper. The electric power supply, which is typically AC, provides a high amperage, low voltage current to a circuit that includes the electrode, the slag, and the vessel. As current passes through the circuit, electrical resistance heating of the slag increases its temperature to a level sufficient to melt the end of the electrode in contact with the slag. As the electrode begins to melt, droplets of molten material form, and an electrode feed mechanism advances the electrode into the slag to provide the desired melt rate. The molten material droplets pass through the heated slag, which removes oxide inclusions and other impurities. Determining the proper melt rate is crucial to provide an ingot that is substantially homogenous and free of voids, and that has a reasonably good quality surface. Here, the inventors determined through experimentation that a melt rate of 14 lbs/min. provided a suitably homogenous and defect-free ESR ingot.

After the 40-inch ESR ingot was cast, it was allowed to cool within the mold for 2 hours and then subjected to the following post-ESR heat treatment. The heat treatment prevented thermal cracking in the ingot in subsequent processing. The ESR ingot was removed from the mold and hot transferred to a heating furnace where it was maintained at about 900° F. (482° C.) for 20 hours. Furnace temperature was then increased by about 25° F./hour (13.9° C./hour) to about 1400° F. (760° C.). Furnace temperature was then further increased at a rate of about 50° F./hour (27.8° C./hour) to about 2175° F. (1191° C.), and the ingot was held at 2175° F. (1191° C.) for at least 32 hours. The ingot was then cooled by reducing furnace temperature about 100° F./hour (55.6° C./hour) to about 1600° F. (871° C.). That temperature was maintained for at least 18 hours. The ingot was then further cooled by reducing the furnace temperature about 75° F./hour (41.7° C./hour) to about 1150° F., and the temperature was held there for about 7 hours. The ingot was removed from the furnace and allowed to air cool.

The 40-inch diameter of the ESR ingot was too large to be vacuum arc remelted using the available VAR apparatus. Therefore, the ingot was press forged to a 32-inch diameter suitable for use on the VAR apparatus. Before forging, the ingot was heated in a furnace to a suitable press forging temperature by a heating sequence developed by the present inventors to prevent thermal cracking. The ingot was first heated at 500° F. (260° C.) for 2 hours. Furnace temperature was then ramped up at 20° F./hour (11.1° C./hour) to 800° F. (427° C.), increased by 30° F./hour (16.7° C./hour) to 1200° F. (649° C.), and then further increased by 40° F./hour (22.2° C./hour) to 2025° F. (1107° C.), where it was maintained for about 8 hours. The ingot was then press forged to a 32-inch diameter, reheating to forging temperature as needed. The 32-inch VAR electrode was maintained at about 1600° F. (871° C.) for a minimum of 20 hours and then conditioned and bandsaw cropped to flatten its ends.

The inventors have discovered that only a narrow and specific VAR melting range will produce a substantially segregation-free VAR ingot, and that VAR control is especially critical during start-up to avoid macrosegregation. The 32-inch VAR electrode was vacuum arc remelted to a 36-inch VAR ingot at a melt rate of about 9.75 lbs/min., which must be controlled within a narrow window. The VAR ingot was then homogenized using a standard furnace homogenization heating cycle, and was then overaged at 1600° F. (871° C.) for 20 hours minimum.

The weight of the 36-inch VAR ingot was significantly in excess of the 21,500 lb. (9772 kg) weight of commercially available 28-inch diameter Alloy 718 ingots. Product from the 36-inch ingot was ultrasonically and macro slice inspected and was found to be free of freckles, and was substantially free of cracks, voids, negative segregation, and other positive segregation. The ESR ingot was considered to be premium quality and suitable for fabrication into parts used in critical applications, such as rotating parts for land-based and aeronautical power generation turbines.

EXAMPLE 2

In the above example, the ESR ingot had a diameter in excess of that which could be used on the available VAR apparatus, which accommodated a VAR electrode of up to about 34 inches ((863 mm). This necessitated that the diameter of the ESR ingot be adjusted by mechanical working. This, in turn, required that the inventors develop a suitable ESR ingot heating sequence to heat the ESR ingot to forging temperature while preventing the occurrence of thermal cracking during forging. If the diameter of the ESR ingot were to more closely approximate the maximum diameter usable on the available VAR apparatus, then the ESR ingot would be less prone to thermal cracking. Press forging or other mechanical working of the ESR ingot may be wholly unnecessary if the size of the ESR ingot were suitable for use directly on the available VAR apparatus. In such case, the ESR ingot could be delivered to the VAR apparatus immediately after the post-ESR heat treatment steps.

Figure 2:
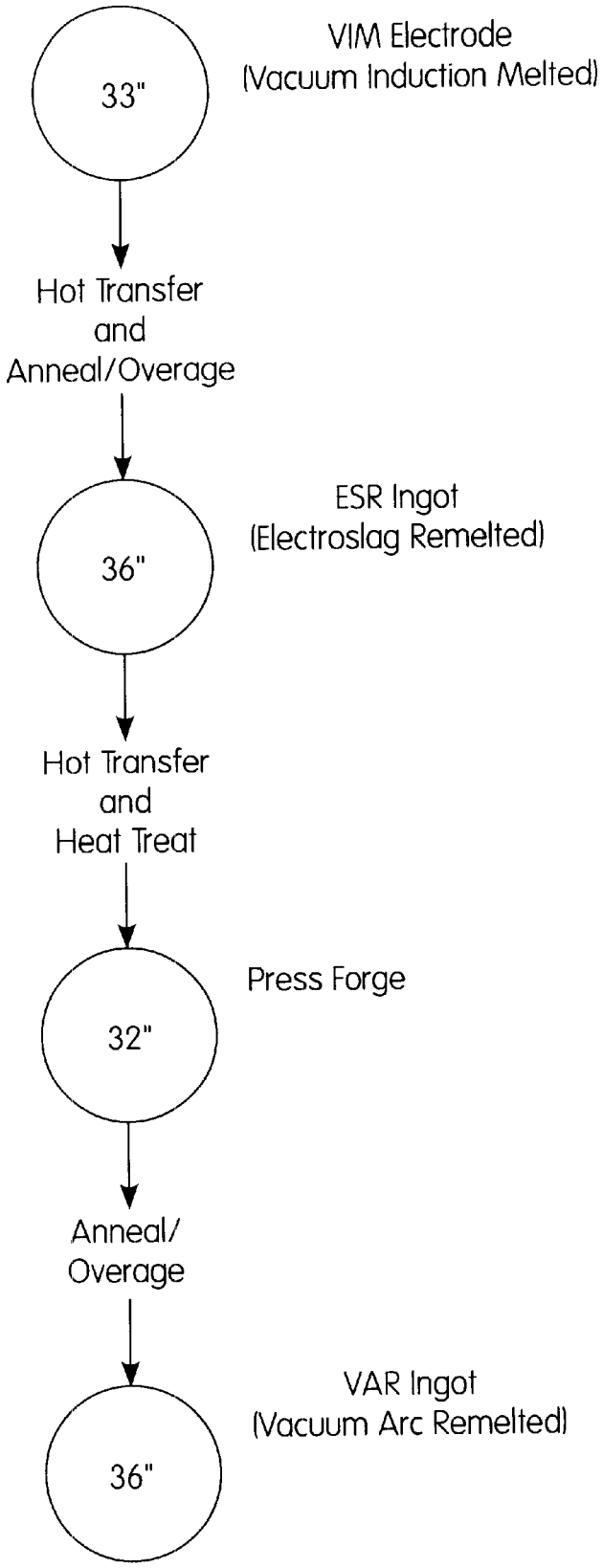
FIG. 2 is a diagram generally illustrating a second embodiment of the method of the present invention, wherein the ESR ingot has a 36-inch diameter and is converted to a 32-inch diameter VAR electrode prior to vacuum arc remelting.

FIG. 2 is a diagram generally depicting a prophetic embodiment of a triple-melt process according to the present invention wherein the ESR apparatus may be used to cast a 36-inch ESR ingot. Because the ESR ingot has a diameter that is less than the 40-inch diameter of the ESR ingot cast in Example 1, there would be less risk of ingot cracking or other working-induced imperfections. In addition, the reduced diameter and greater length of the ESR ingot would reduce the likelihood that the ESR ingot would crack or suffer from significant segregation once cast.

As indicated in FIG. 2, the VIM electrode is cast to a 33-inch diameter ingot. The VIM ingot is then hot transferred and may be annealed and overaged as described in Example 1. In particular, the VIM ingot is allowed to remain in the casting mold for 6 to 8 hours before being stripped and loaded into the heat-treating furnace. It is believed that the hold time in the casting mold could be reduced for smaller diameter VIM ingots. The 33-inch VIM ingot is then electroslag remelted by the process generally described in, Example 1. The ingot is then hot transferred and subjected to a post-ESR heat treatment as described above in Example 1. Subsequent to the post-ESR heat treatment, the ESR ingot is ramped up to forging temperature and press forged to 32-inch diameter as generally described in Example 1. The 32-inch forging is overaged and then vacuum arc remelted to a 36-inch VAR ingot as generally described in Example 1. The VAR ingot may then be homogenized by standard homogenization treatments, or may besuitably processed in other ways. It is believed that a premium quality Alloy 718 VAR ingot, comparable to the ingot produced by the method of Example 1, would result.

EXAMPLE 3

Figure 3:
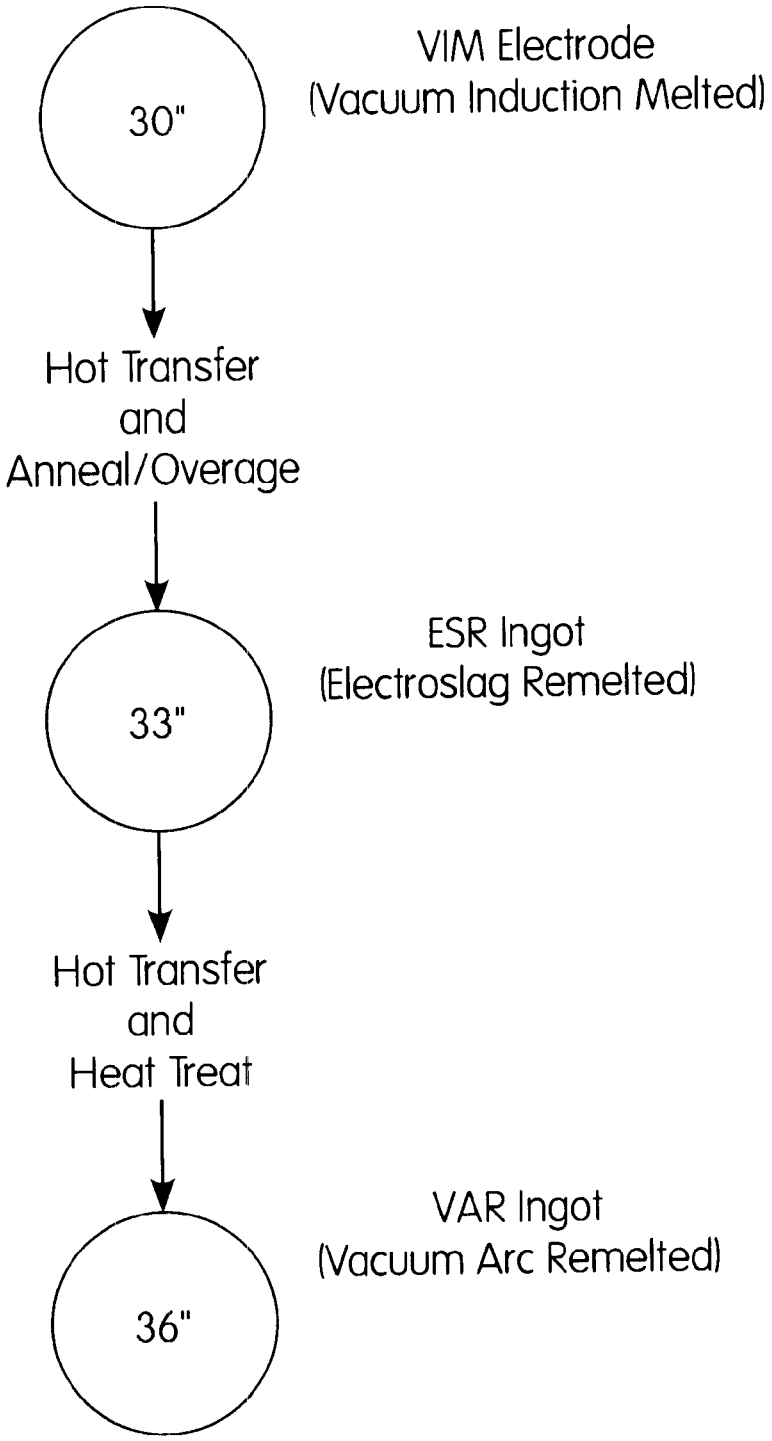
FIG. 3 is a diagram of a third embodiment of the method of the present invention, wherein a 33-inch diameter ESR ingot is cast and is suitable without mechanical conversion for use as the VAR electrode.

FIG. 3 is a diagram an alternative prophetic embodiment of a triple-melt process within the present invention wherein the 30-inch diameter of the as-cast ESR ingot is directly suitable for use with the ESR apparatus. A 30-inch VIM electrode is electroslag remelted to a 33-inch ESR ingot. The ESR ingot is hot transferred and heat treated as described in Example 1, and is then vacuum arc remelted, without reduction in diameter, to a 36-inch diameter VAR ingot. The VAR ingot may then be homogenized and further processed as described in Example 1. The process depicted in FIG. 3 differs from that of FIG. 1 only in that the diameters of the VIM electrode and ESR ingot differ from those of Example 1, and no press forging operation or ramped heat-up to forging temperature are needed. A premium quality 36-inch diameter Alloy 718 ingot would result.

EXAMPLE 4

Several VAR ingots of Allvac 718 material having diameters greater than 30 inches were prepared by the method of the present invention and inspected. Parameters of the several runs are set forth in the following chart. In several of the runs, various VAR melt rates were evaluated to determine the effects on quality of the resulting VAR ingot.

| Step | Heat 215G | Heat 420G | Heat 533G | Heat 631G | Heat 729G |
|---|---|---|---|---|---|
| VIM Electrode Diameter | 36 | 36 | 36 | 36 | 36 |
| VIM Anneal/ Overage | 1550° F. (843° C.) for 13 hours 24 minutes | 1550° F. (843° C.) for 16 hours 48 minutes | 1550° F. (843° C.) for 15 hours 55 minutes | 1550° F. (843° C.) for 41 hours | 1550° F. (843° C.) for 29 hours |
| Flux | 60F-20-0-20 + $TiO_2$ | 60F-20-0-20 + $TiO_2$ | 60F-20-0-20 + $TiO_2$ | 60F-20-0-20 + $TiO_2$ | 60F-20-0-20 + $TiO_2$ |
| ESR Melt Rate | 14 lbs/minute | 14 lbs/minute | 14 lbs/minute | 14 lbs/minute | 14 lbs/minute |
| Crucible Cool Time | 1.5 hours (1 hour 50 minutes total transfer time) | 2 hours | 2 hours | 2 hours (+ 20 minutes to strip to hot box) | 2 hours (+ 30 minutes to strip to hot box) |
| ESR Ingot Diameter | 40 inches | 40 inches | 40 inches | 40 inches | 40 inches |
| Post ESR Heat Treatment | 900° F. (482° C.) for 33 hours 22 minutes. 1150° F. (621° C.) for 7 hours. Ramp up at 25° F./hour (13.8° C./hour) to 1300° F. (704° C.), then 50° F./hour (27.7° C./hour) to 1650° F. (899° C.), and 75° F./hour (41.6° C./hour) to 2175° F. (1191° C.). Hold for 24 hours at 2175° F. (1191° C.). Lower to 2025° F. (1107° C.), hold for 6 hours and forge. | 900° F. (482° C.) for 28 hours. 1150° F. (621° C.) for 19 hours. Ramp up at 25° F./hour (13.8° C./hour) to 1300° F. (704° C.), then 50° F./hour (27.7° C./hour) to 1650° F. (899° C.), and 75° F./hour (41.6° C./hour) to 2175° F. (1191° C.). Hold for 24 hours at 2175° F. (1191° C.). Lower to 2025° F. (1107° C.), hold for 9 hours and forge. | 900° F. (482° C.) for 21 hours. 1150° F. (621° C.) for 4 hours. Ramp up at 25° F./hour (13.8° C./hour) to 1300° F. (704° C.), then 50° F./hour (27.7° C./hour) to 1650° F. (899° C.), and 75° F./hour (41.6° C./hour)to 2175° F. (1191° C.). Hold for 24 hours at 2175° F. (1191° C.). Lower to 2025° F. (1107° C.), hold for 69.5 hours and forge. | 900° F. (482° C.) for 33 hours. 1150° F. (621° C.) for 4 hours. Ramp up at 25° F./hour (13.8° C./hour) to 1300° F. (704° C.), then 50° F./hour (27.7° C./hour) to 1650° F. (899° C.), and 75° F./hour (41.6° C./hour) to 2.175° F. (1191° C.). Hold for 24 hours at 2175° F. (1191° C.). Air cool. | 900° F. (482° C.) for 42.5 hours. Ramp up at 25° F./hour (13.8° C./hour) to 1400° F. (760° C.), then 50° F./hour (27.7° C./hour) to 2175° F. (1191° C.). Hold for 32 hours at 2175° F. (1191° C.). Ramp furnace down at 100° F./hour (55.5° C./hour) to 1600° F. (871° C.) and hold for 18 hours min. Ramp down at 75° F./hour (41.6° C./hour) to 1150° F. (621° C.) and hold for 7 hours min. Air cool. |
| Press | Forge to 31 15/16 inches in three operations | Forge to 31 15/16 inches in three operations | Forge to 31 15/16 inches in five operations. | Reheat at 500° F. (260° C.) for 8 hours, ramp at 25° F./hour (13.8° C./hour) to 1300° F. (704° C.). | Reheat at 500° F. (260° C.) for 3.5 hours, ramp at 20°/hour (11.1° C./hour) to |

-continued

| Step | Heat 215G | Heat 420G | Heat 533G | Heat 631G | Heat 729G |
|---|---|---|---|---|---|
| | | | | Ramp at 50° F./hour (27.7° C./hour) to 2025° F. (1107° C.). Hold at 2025° F. (1107° C.) and forge | 800° F. (427° C.), ramp at 30° F./hour (16.7° C./hour) to 1200° F. (649° C.), ramp at 40° F./hour to 2025° F. (1107° C.). Hold 16 hours at 2025° F. (1107° C.) and press, reheating as needed. |
| Forgeback Diameter | 31 15/16 inches | 31 15/16 inches | 31 15/16 inches | Not applicable | 32 inches |
| Overage | 1600° F. (871° C.) for 21 hours and air cool | 1600° F. (871° C.) for 23.5 hours and air cool | 1600° F. (871° C.) for 25 hours and air cool | Not applicable | 1600° F. (871° C.) for 20 hours and air cool |
| Melt Rate | 3 trialed: 9.75, 10.5, and 9.0 lbs/minute | 2 trialed: 10.0 and 9.5 lbs/minute | 3 trialed: 10.2, 9.25, and 9.75 lbs/minute | Not applicable | 9.75 |
| VAR Ingot Diameter/ Weight | 36 inches 27,355 pounds | 36 inches 28,570 pounds | 36 inches 30,744 pounds | Not applicable | 36 inches 37,880 pounds |
| Homogenize | Yes | Yes | Yes | Not applicable | Yes |
| Comments | Positive segregation found at highest melt rate. Two ultrasonic indications found in VAR start up area but no freckles found. Material melted under steady state conditions acceptable for premium quality applications. | No ultrasonic indications. Material melted under steady state conditions acceptable for premium quality applications. | No ultrasonic indications. Material melted under steady state conditions acceptable for premium quality applications. | ESR ingot cracked on removal from reheat furnace. Ingot scrapped. | Sound, crack free ingot after VAR |

Evaluation of the VAR ingots was conducted on 10-inch diameter billet produced by draw forging VAR ingots, followed by GFM forging to final diameter. The forged billets were peeled and polished to remove surface irregularities after which they were ultrasonic inspected for internal cracks and voids that are usually associated with areas of negative segregation. Transverse slices cut from several locations along the length of the billets representing all melt rates were then chemically etched to reveal areas of negative and positive segregation. The absence of sonic indications and segregation defects was sufficient to classify the material as being of premium quality.

It is to be understood that the present description illustrates those aspects of the invention relevant to a clear understanding of the invention. Certain aspects of the invention that would be apparent to those of ordinary skill. in the art and that, therefore, would not facilitate a better understanding of the invention have not been presented in order to simplify the present description. Although the present invention has been described in connection with certain embodiments, those of ordinary skill in the art will, upon considering the foregoing description, recognize that many modifications and variations of the invention may be employed. All such variations and modifications of the invention are intended to be covered by the foregoing description and the following claims.

We claim:

1. A method of producing a nickel base superalloy that is substantially free of positive and negative segregation, the method comprising:

casting an alloy that is a nickel base superalloy within a casting mold;

annealing and averaging the alloy by heating the alloy at at least 1200° F. (649° C.) for at least 10 hours;

electroslag remelting the alloy at a melt rate of at least 8 lbs/min. (3.63 kg/min.);

transferring the alloy to a heating furnace within 4 hours of complete solidification;

holding the alloy within the heating furnace at a first temperature of 600° F. (316° C.) to 1800° F. (982° C.) for at least 10 hours;

increasing the furnace temperature from the first temperature to a second temperature of at least 2125° F. (1163° C.) in a manner to inhibit thermal stresses within the alloy;

holding at the second temperature for at least 10 hours;

vacuum arc remelting a VAR electrode of the alloy at a melt rate of 8 to 11 lbs/minute (3.63 to 5 kg/minute) to provide a VAR ingot.

2. The method of claim 1, wherein the VAR ingot has a diameter greater than 30 inches (762 mm).

3. The method of claim 1, wherein the VAR ingot has a diameter of at least 36 inches (914 mm).

4. The method of claim 1, wherein the weight of the VAR ingot is greater than 21,500 lbs (9772 kg).

5. The method of claim 1, wherein the nickel base alloy is one of Alloy 718 and Alloy 706.

6. The method of claim 1, wherein the nickel base alloy comprises about 50.0 to about 55.0 weight percent nickel;

about 17 to about 21.0 weight percent chromium;

0 up to about 0.08 weight percent carbon, 0 up to about 0.35 weight percent manganese;

0 up to about 0.35 weight percent silicon;

about 2.8 up to about 3.3 weight percent molybdenum;

at least one of niobium and tantalum wherein the sum of niobium and tantalum is about 4.75 up to about 5.5 weight percent;

about 0.65 up to about 1.15 weight percent titanium;
about 0.20 up to about 0.8 weight percent aluminum;
0 up to about 0.006 weight percent boron; and
iron and incidental impurities.

7. The method of claim 1, wherein the nickel base alloy is consists essentially of:

about 54.0 weight percent nickel;
about 0.5 weight percent aluminum;
about 0.1 weight percent carbon;
about 5.0 weight percent niobium;
about 18.0 weight percent chromium;
about 3.0 weight percent molybdenum;
about 0.9 weight percent titanium; and
iron and incidental impurities.

8. The method of claim 1, wherein casting the nickel base alloy comprises melting and optionally refining the alloy by at least one of vacuum induction melting, argon-oxygen decarburization, and vacuum oxygen decarburization.

9. The method of claim 1, wherein annealing and over-aging the alloy comprises heating the alloy at at least 1200° F. (649° C.) for at least 18 hours.

10. The method of claim 1, wherein annealing and over-aging the alloy comprises heating the alloy at at least 1550° F. (843° C.) for at least 10 hours.

11. The method of claim 1, wherein electroslag remelting the alloy comprises electroslag remelting at a melt rate of at least 10 lbs/minute (4.54 kg/minute).

12. The method of claim 1, wherein holding the alloy within the heating furnace comprises holding the alloy at a furnace temperature of at least 600° F. (316° C.) up to 1800° F. (982° C.) for at least 20 hours.

13. The method of claim 1, wherein holding the alloy within the heating furnace comprises holding the alloy at a furnace temperature of at least 900° F. (482° C.) up to 1800° F. (982° C.) format least 10 hours.

14. The method of claim 1, wherein increasing the furnace temperature comprises increasing the furnace temperature from the first temperature to the second temperature in a multi-stage manner comprising:

increasing the furnace temperature from the first temperature by no greater than 100° F./hour (55.6° C./hour) to an intermediate temperature; and further increasing the furnace temperature by no greater than 200° F./hour (111° C./hour) from the intermediate temperature to the second temperature.

15. The method of claim 14, wherein the first temperature is less than 1000° F. (583° C.) and the intermediate temperature is at least 1000° F. (583° C.).

16. The method of claim 1, wherein the first temperature is less than 1400° F. (760° C.) and the intermediate temperature is at least 1400° F. (760° C.).

17. The method of claim 1, wherein the second temperature is at least 2175° F. (1191° C.).

18. The method of claim 1, wherein the alloy is held at the second temperature for at least 24 hours.

19. The method of claim 1, wherein electroslag remelting the alloy provides an ESR ingot having a diameter that is greater than a desired diameter of the VAR electrode, the method further comprising, subsequent to holding at the second temperature:

mechanically working the ESR ingot to alter dimensions of the ingot and to provide a VAR electrode with the desired diameter.

20. The method of claim 14, further comprising, subsequent to holding the alloy at the second temperature and prior to mechanically working the ESR ingot:

cooling the alloy to a mechanical working temperature at a cooling rate not greater than 200° F./hour (111° C./hour).

21. The method of claim 1, further comprising, subsequent to holding the alloy at the second temperature and prior to vacuum arc remelting the VAR electrode:

cooling the alloy from the second temperature to room temperature by a cooling process comprising reducing the furnace temperature at a rate not greater than 200° F./hour (111° C./hour) from the second temperature to a first intermediate temperature not greater than 1750° F. (982° C.), and holding at the first intermediate temperature for at least 10 hours.

22. The method of claim 21, wherein cooling the alloy further comprises:

reducing the furnace temperature at a rate nor greater than 150° F./hour (83.3° C./hour) from the first intermediate temperature to a second intermediate temperature not greater than 1400° F. (760° C.), and holding at the second intermediate temperature for at least 5 hours.

23. The method of claim 22, wherein subsequent to holding at the second intermediate temperature, the alloy is cooled in air to about room temperature.

24. The method of claim 1, further comprising, subsequent to holding at the second temperature and prior to mechanically working the ESR ingot:

cooling the alloy from the second temperature to about room temperature in a manner that inhibits thermal stresses in the alloy; and heating the alloy to a suitable mechanical working temperature in a manner that inhibits thermal stresses in the alloy.

25. The method of claim 24, wherein heating the alloy to a suitable mechanical working temperature comprises:

heating the alloy within a heating furnace at a furnace temperature of at least 500° F. (260° C.) for at least 2 hours;

increasing the furnace temperature, by at least about 20° F./hour (11.1° C./hour) to at least 800° F. (427° C.);

further increasing the furnace temperature at least about 30° F./hour (1 6.7° C./hour) to at least 1200° F. (649° C.); and further increasing the furnace temperature by at least about 40° F./hour (22.2° C./hour) to a temperature of at least 2025° F. (1107° C.), and holding at the temperature until the alloy achieves a substantially uniform temperature throughout.

26. The method of claim 19, wherein the ESR ingot has a diameter of about 34 inches (864 mm) to about 40 inches (1016 mm) and the VAR electrode has a smaller diameter no greater than about 34 inches (864 mm).

27. A method of producing a nickel base alloy that is substantially free of positive and negative segregation, the method comprising:

casting a nickel base alloy in, a casting mold, wherein the nickel base superalloy is Alloy 718;

annealing and averaging the alloy by heating the alloy at at least 1550° F. (843° C.) for at least 10 hours;

electroslag remelting the alloy at a melt rate of at least 10 lbs/min. (4.54 kg/min.);

transferring the alloy to a heating furnace within 4 hours of complete solidification after electroslag remelting;

holding the alloy within the heating furnace at a first furnace temperature of 900° F. (482° C.) to 1800° F. (982° C.) for at least 10 hours;

increasing the furnace temperature by no greater than 100° F./hour (55.6° C./hour) to an intermediate furnace temperature; and further increasing the furnace temperature by no greater than 200° F./hour (111° C./hour) from the intermediate furnace temperature to a second furnace temperature of at least 2125° F. (1163° C.), and holding at the second temperature for at least 10 hours; and vacuum arc remelting a VAR electrode of the alloy at a melt rate of 9 to 10.25 lbs/minute (4.09 to 4.66 kg/min) to provide a VAR ingot.

28. The method of claim 27, wherein the VAR ingot has a diameter greater than 30 inches (762 mm).

29. The method of claim 27, wherein the VAR ingot has a diameter of at least 36 inches (914 mm).

30. The method of claim 27, wherein the weight of the VAR ingot is greater than 21,500 lbs (9772 kg).

31. The method of claim 27, wherein the nickel base alloy comprises:

about 50.0 to about 55.0 weight percent nickel;

about 17 to about 21.0 weight percent chromium;

0 up to about 0.08 weight percent carbon;

0 up to about 0.35 weight percent manganese;

0 up to about 0.35 weight percent silicon;

about 2.8 up to about 3.3 weight percent molybdenum;

at least one of niobium and tantalum wherein the sum of niobium and tantalum is about 4.75 up to about 5.5 weight percent;

about 0.65 up to about 1.15 weight percent titanium;

about 0.20 up to about 0.8 weight percent aluminum, 0 up to about 0.006 weight percent boron; and iron and incidental impurities.

32. The method of claim 27, wherein electroslag remelting the alloy provides an ESR ingot having a diameter that is greater than a desired diameter of the VAR electrode, the method further comprising:

cooling the alloy from the second temperature to a suitable mechanical working temperature and then mechanically working the alloy to provide a VAR electrode with the desired diameter.

33. The method of claim 27, wherein electroslag remelting the alloy provides an ESR ingot having a diameter that is greater than a desired diameter of the VAR electrode, the method further comprising:

cooling the alloy from the second temperature to about room temperature in a manner that inhibits thermal stresses in the alloy;

heating the alloy to a suitable mechanical working temperature in a manner that inhibits thermal stresses in the alloy;

mechanically working the alloy to provide a VAR electrode with the desired diameter.

* * * * *

UNITED STATES PATENT AND TRADEMARK OFFICE

CERTIFICATE OF CORRECTION

PATENT NO. : 6,416,564 B1
DATED : July 9, 2002
INVENTOR(S) : Bond et al.

It is certified that error appears in the above-identified patent and that said Letters Patent is hereby corrected as shown below:

Title page,
Item [54], ABSTRACT,
Line 5, delete "8 lbs/min" and substitute therefore -- 8 lbs/min. --.
Line 5, delete "3.63 kg/mm.)," and substitute therefore -- 3.63 kg/min.), --
Line 8, after the word "provided" delete "form" and substitute therefore -- from --.

Column 1,
Line 40, delete "in, the" and substitute therefore -- in the -- .
Line 50, delete "carbides.," and substitute therefore -- carbides, --.

Column 2,
Line 7, delete "significant, positive" and substitute therefore -- significant positive --.
Line 14, delete "other-segregation-prone" and substitute therefore -- other segregation-prone --.
Line 32, delete "land based" and substitute therefore -- due to the --.
Line 58, delete "due the" and substitute therefore -- due to the --.

Column 3,
Line 22, delete "by, heating" and substitute therefore -- by heating --.
Line 29, delete "and, is" and substitute therefore -- and is --.
Line 37, delete "single, stage" and substitute therfore -- single stage --.
Line 46, delete "of-the" and substitute therefore -- of the --.

Column 4,
Line 21, delete "subsequently. increased" and substitute therefore -- subsequently increased --.
Line 39, delete "to, premium" and substitute therefore -- to premium --.

Column 6,
Line 27, delete "melting-process" and substitute therefore -- melting process --.
Line 60, delete "to-the" and substitute therefore -- to the --.
Line 63, delete "is, important" and substitute therefore -- is important --.

Column 7,
Line 4, delete "is least" and substitute therefore -- is at least --.
Line 5, delete "Unto" and substitute therefore -- up to --.
Line 5, delete "180° F." and substitute therefore -- 1800° F. --.
Line 6, delete "is, at" and substitute therefore -- is at --.
Line 21, delete "100º /hour" and substitute therefore -- 100º F./hour --.

UNITED STATES PATENT AND TRADEMARK OFFICE

CERTIFICATE OF CORRECTION

PATENT NO. : 6,416,564 B1
DATED : July 9, 2002
INVENTOR(S) : Bond et al.

It is certified that error appears in the above-identified patent and that said Letters Patent is hereby corrected as shown below:

Column 8,
Lines 46-47, delete “temperature-less” and substitute therefore -- temperature less --.

Column 9,
Line 2, delete “data” and substitute therefore -- at a --.
Line 36, delete “(843º F.)” and substitute therefore -- (843º C.) --.

Column 10,
Line 46, delete “inspected and” and substitute therefore -- inspected, and --.
Line 58, delete “((863 mm).” And substitute therefore -- (863 mm) --.

Column 11,
Line 24, delete “in, Example 1.” And substitute therefore -- in Example 1. --.

Column 12,
Line 8, delete “diagram an” and substitute therefore -- diagram of an --.
Table, under the column heading Heat 729G across from the row heading Press, delete “20º F./hour” and substitute therefore -- 20º F./hour --.

Column 13,
Line 35, delete “forging VAR”and substitute therefore -- forging the VAR --.
Line 49, delete “skill. In” and substitute therefore -- skill in --.
Line 66, Claim #1, delete “averaging” and substitute therefore -- overaging --.

Column 15,
Lines 5-6, delete “alloy is consists” and substitute therefore -- alloy consists --.
Line 9, delete “0.1” and substitute therefore -- 0.01 --.
Line 18, delete “argon-oxygen” and substitute therefore -- argon oxygen --.
Line 36, delete “format” and substitute therefore -- for at --.

Column 16,
Line 16, delete “nor” and substitute therefore -- not --.
Line 39, delete “temperature, by” and substitute therefore -- temperature by --.
Line 42, delete “(1 6.7ºC/hour)” and substitute therefore -- (16.7ºC/hour) --.
Line 56, delete “in, a” and substitute therefore -- in a --.
Line 58, delete “averaging” and substitute therefore -- overaging --.

UNITED STATES PATENT AND TRADEMARK OFFICE

CERTIFICATE OF CORRECTION

PATENT NO. : 6,416,564 B1
DATED : July 9, 2002
INVENTOR(S) : Bond et al.

It is certified that error appears in the above-identified patent and that said Letters Patent is hereby corrected as shown below:

Column 18,
Line 2, delete “aluminum,” and substitute therefore -- aluminum; --

Signed and Sealed this

Tenth Day of August, 2004

JON W. DUDAS
*Acting Director of the United States Patent and Trademark Office*